US012808631B2

(12) United States Patent
Cook et al.

(10) Patent No.: US 12,808,631 B2
(45) Date of Patent: Nov. 24, 2026

(54) BOW SIGHT WITH IMPROVED ACCURACY AND BOW SIGHT ATTACHMENT FOR IMPROVED ACCURACY

(71) Applicant: Bumble Sights, LLC, Bellville, OH (US)

(72) Inventors: Victor Cook, Columbus, OH (US); Mathias Pamer, Bellville, OH (US); Rodolfo Lopez, Jr., Bellville, OH (US); Richard Pavkov, Roxboro, NC (US)

(73) Assignee: Bumble Sights, LLC, Bellville, OH (US)

( * ) Notice: Subject to any disclaimer, the term of this patent is extended or adjusted under 35 U.S.C. 154(b) by 0 days.

(21) Appl. No.: 19/428,869

(22) Filed: Dec. 22, 2025

(65) Prior Publication Data

US 2026/0177354 A1 Jun. 25, 2026

Related U.S. Application Data

(60) Provisional application No. 63/736,862, filed on Dec. 20, 2024.

(51) Int. Cl.
*F41G 1/467* (2006.01)
*F41G 1/34* (2006.01)

(52) U.S. Cl.
CPC ..... *F41G 1/467* (2013.01); *F41G 1/345* (2013.01)

(58) Field of Classification Search
CPC ..... F41G 1/467; F41G 1/345
See application file for complete search history.

(56) References Cited

U.S. PATENT DOCUMENTS

| | | | | |
|---|---|---|---|---|
| 4,894,921 | A * | 1/1990 | Barlow | F41G 1/467 33/265 |
| 6,601,308 | B2 * | 8/2003 | Khoshnood | F41G 1/467 42/131 |
| 7,487,594 | B2 * | 2/2009 | Labowski | F41G 1/467 124/87 |
| 7,631,433 | B2 * | 12/2009 | Labowski | F41G 1/467 124/87 |
| 8,316,551 | B2 * | 11/2012 | Gorsuch | F41G 1/467 124/87 |
| 8,448,341 | B2 * | 5/2013 | Haney | F41G 11/003 124/88 |
| 8,739,419 | B1 * | 6/2014 | Pulkrabek | F41G 1/467 124/87 |
| 9,310,173 | B2 * | 4/2016 | Bay | F42B 6/04 |
| 9,429,393 | B2 * | 8/2016 | Graziano | F41B 5/10 |
| 9,970,730 | B2 * | 5/2018 | Thacker, Jr. | F41B 5/1434 |
| 10,184,757 | B1 * | 1/2019 | Ahlgren | F41G 1/467 |

(Continued)

*Primary Examiner* — Yaritza Guadalupe-Mccall

(74) *Attorney, Agent, or Firm* — Standley Law Group LLP; Bryan P. Finneran; Adam J. Smith

(57) ABSTRACT

A device is described that involves an accessory for a bow sight/scope for promoting bow accuracy. The device may alert an archer/bowman when the bow is not oriented at true vertical axial orientation, which is an especially important position to maintain while shooting a compound bow. In one example of the device of the present invention, lights are provided at the device to alert the archer/bowman when the bow is properly vertically oriented, and to alert the archer/bowman when the bow requires adjustment of its vertical orientation. The device may attach around a rim of a bow scope.

18 Claims, 16 Drawing Sheets

(56) References Cited

U.S. PATENT DOCUMENTS

| | | | | |
|---|---|---|---|---|
| 10,670,372 | B2 * | 6/2020 | VanCamp | F41G 1/30 |
| 11,022,403 | B2 * | 6/2021 | VanCamp | F41G 3/065 |
| 11,255,638 | B2 * | 2/2022 | Roman | F41G 3/08 |
| 11,754,370 | B2 * | 9/2023 | Mogle | F41G 1/44 124/87 |
| 11,859,947 | B2 * | 1/2024 | VanCamp | F41G 1/467 |
| 11,898,820 | B2 * | 2/2024 | Hindman | F41G 1/467 |
| 11,965,712 | B2 * | 4/2024 | Mogle | F41G 1/467 |
| 2010/0115778 | A1 * | 5/2010 | Gorsuch | F41G 1/467 356/3 |
| 2014/0171238 | A1 * | 6/2014 | Bay | F42B 12/365 473/570 |
| 2020/0232764 | A1 * | 7/2020 | Macdonald | F41G 1/467 |
| 2025/0341382 | A1 * | 11/2025 | Compton | F41G 1/467 |
| 2026/0126270 | A1 * | 5/2026 | Griggs | F41G 1/345 |
| 2026/0177354 | A1 * | 6/2026 | Cook | F41G 1/467 |

* cited by examiner

BOW SIGHT WITH IMPROVED ACCURACY AND BOW SIGHT ATTACHMENT FOR IMPROVED ACCURACY

CROSS-REFERENCE TO RELATED APPLICATIONS

This non-provisional patent application claims priority to U.S. Provisional Application Ser. No. 63/736,862, filed on Dec. 20, 2024, the disclosure of which is incorporated by reference as if fully recited herein.

TECHNICAL FIELD

The present invention relates generally to archery equipment, and more particularly to a bow sight accessory device for promoting bow accuracy as well as archery bows incorporating the same and methods for operating the same. The device may alert an archer/bowman when the bow is not oriented at true vertical axial orientation. In one example embodiment, a plurality of lights are provided at the device to alert the archer/bowman when the bow is oriented at true vertical axial orientation, and to alert the archer/bowman when the bow is not oriented at true vertical axial orientation. The device may attach around a rim of a bow scope.

BACKGROUND AND SUMMARY OF THE INVENTION

True vertical axial orientation (also referred to herein as "true vertical axial alignment," "true vertical position," and "0 degrees" position) of a compound bow involves the compound bow being positioned at 90 degrees (or at least approximately: there may be a small margin of error, such as, for example, plus or minus 3 degrees) with respect to the force of gravity/gravitational pull (i.e., towards the ground-though the angle between the bow in true vertical position and the ground may be different from 90 degrees, such as when the ground is at an incline). True vertical axial orientation is important when target shooting, hunting, some combination thereof, or the like with a bow (particularly with a compound bow). When an archer releases an arrow from a bow that is not oriented in a true vertical axial orientation, the arrow will be off target from the aiming point indicated by the bow scope. Thus, it is difficult to deliver an arrow accurately and consistently within a target area if the compound bow is not at true vertical axial orientation. The more canted/offline from true vertical axial alignment the bow is, the more off target from the aiming point indicated by the bow scope the arrow will be. Therefore, when using a compound bow, it is helpful to have access to an indicator of bow true vertical orientation.

Bubble spirit levels, which are known in the art, have been attached to bow sights/scopes to assist archers in an analogue view of vertically orienting the bow. However, one issue with using bubble spirit levels for vertically orienting a bow is that the archer is required to take one's eyes off the target to observe the position of the bubble. This may cause the archer to lose sight of a target, become disoriented, fail to maintain true vertical axial orientation of the bow after the archer switches one's sight away from the bubble, some combination thereof, or the like.

Another issue with using bubble spirit levels for vertically orienting a bow is that bubble spirit levels offer limited precision. For example, the bubble in a bubble spirit level may appear centrally oriented to the archer when the bow is actually tilted slightly to the left or right away from true vertical axial orientation. This may result in inaccurate and/or inconsistent arrow delivery. The aforementioned issues may be exacerbated and/or more likely to occur with less experienced archers. The aforementioned issues may also be exacerbated and/or more likely to occur when the archer is standing on non-level ground. Even the slightest deviations of the bow from the true vertical axial orientation may lead to inaccurate shots, missed targets, wasted arrows, and/or wasted opportunities. In the context of compound bow hunting, a wasted opportunity may involve a target animal escaping.

The aforementioned shortcomings speak to the need for a bow accessory that allows for the archer to assess vertical orientation of the bow without taking one's eyes off a target, and optimizes true vertical axial orienting of the bow, even for inexperienced archers and/or archers standing on non-level ground.

In view of this, it is beneficial to have a device for promoting bow accuracy, a bow incorporating the same, and a method for operating the same, various embodiments of which are illustrated and described in detail herein.

According to the present invention in one aspect, an exemplary device for promoting bow accuracy involves an accessory adapted to be secured at a compound bow sight/scope. The device may help an archer, even a less experienced archer, confirm the bow's true vertical alignment. This may minimize potential errors that can negatively affect shot accuracy.

According to the present invention in one aspect, an exemplary device for promoting bow accuracy comprises a front portion and a rear portion. The front portion may be secured to a front face of a bow scope, and the rear portion may be secured to a rear face of the bow scope. A plurality of fasteners may extend between the front and rear portions, and may cause each the front and rear portions to be secured to the scope and linked to one another. The fasteners may be engaged by a basic tool such as a screwdriver, permitting ease of attachment of the device to the bow scope. A plurality of lights may be provided at the front portion of the device. The lights may illuminate green when the bow is oriented at true vertical axial orientation, indicating to the archer/bowman that the arrow is ready to be released.

A light positioned at a left side of the front portion of the device may illuminate (e.g., red or amber) when the bow is canted to the left from the proper true vertical axial orientation. A light positioned at a right side of the front portion of the device may illuminate (e.g., red or amber) when the bow is canted to the right from the proper true vertical axial orientation. Red or amber light of the device may indicate to the archer/bowman that the vertical orientation of the bow requires adjustment. The bow may be a compound bow. The scope may be one of any number of different scopes. The lights may be digital LEDs imbedded at the left and right sides of the front portion.

Advantages of exemplary embodiments may include, as non-limiting examples, improved arrow shot accuracy, improved arrow shot precision, less missed targets, less escaped animals (in the context of bow hunting), ease of use for archers of various different skill and/or experience levels, adjustability and capacity to be used with various different bows, durability and longevity, and/or usefulness on non-flat standing surfaces.

BRIEF DESCRIPTION OF THE DRAWINGS

Novel features and advantages of the present invention, in addition to those expressly mentioned herein, will become apparent to those skilled in the art from a reading of the following detailed description in conjunction with the accompanying drawings. The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EXEMPLARY EMBODIMENT(S)

Figure 1:
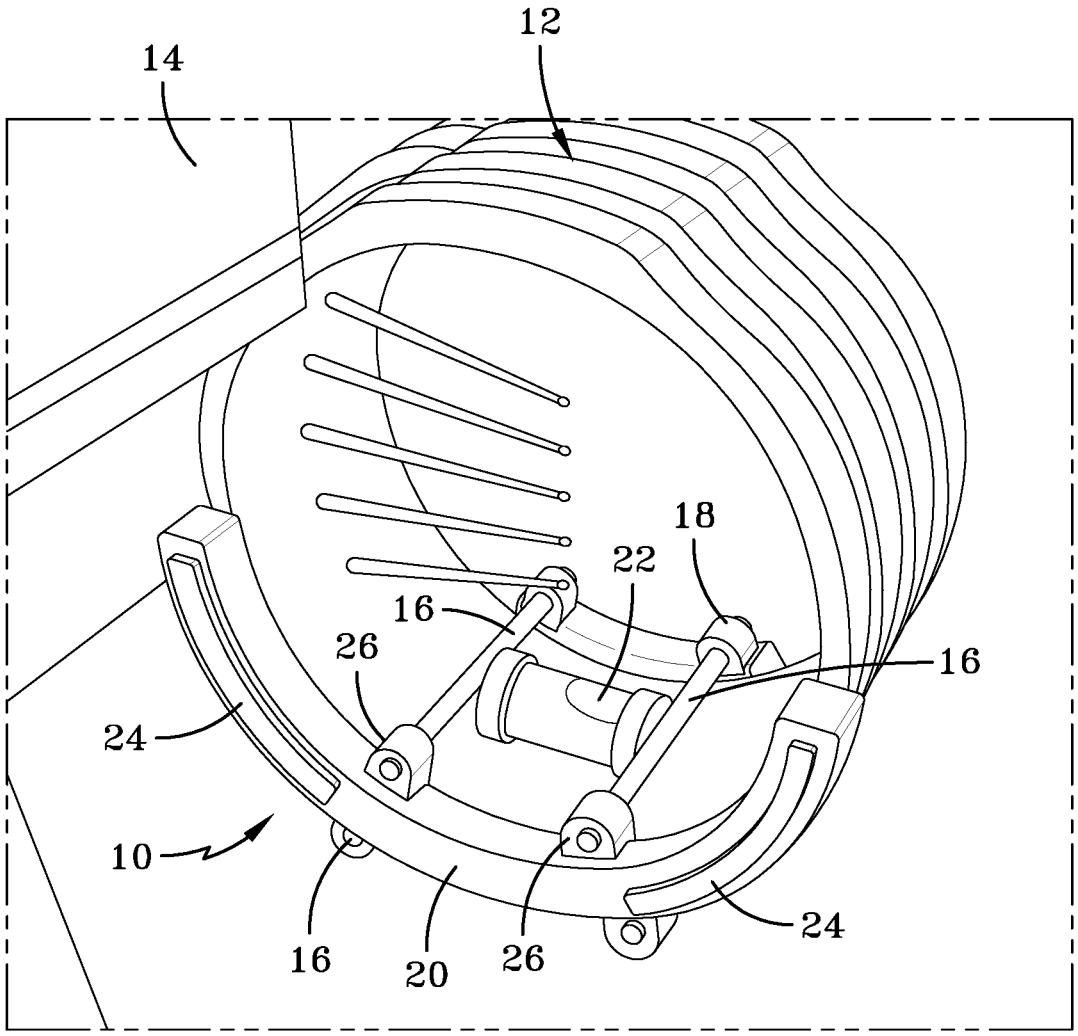
FIG. 1 illustrates a perspective view of an exemplary device for promoting bow accuracy of the present invention, wherein the device is attached to a bow scope.
Figure 2:
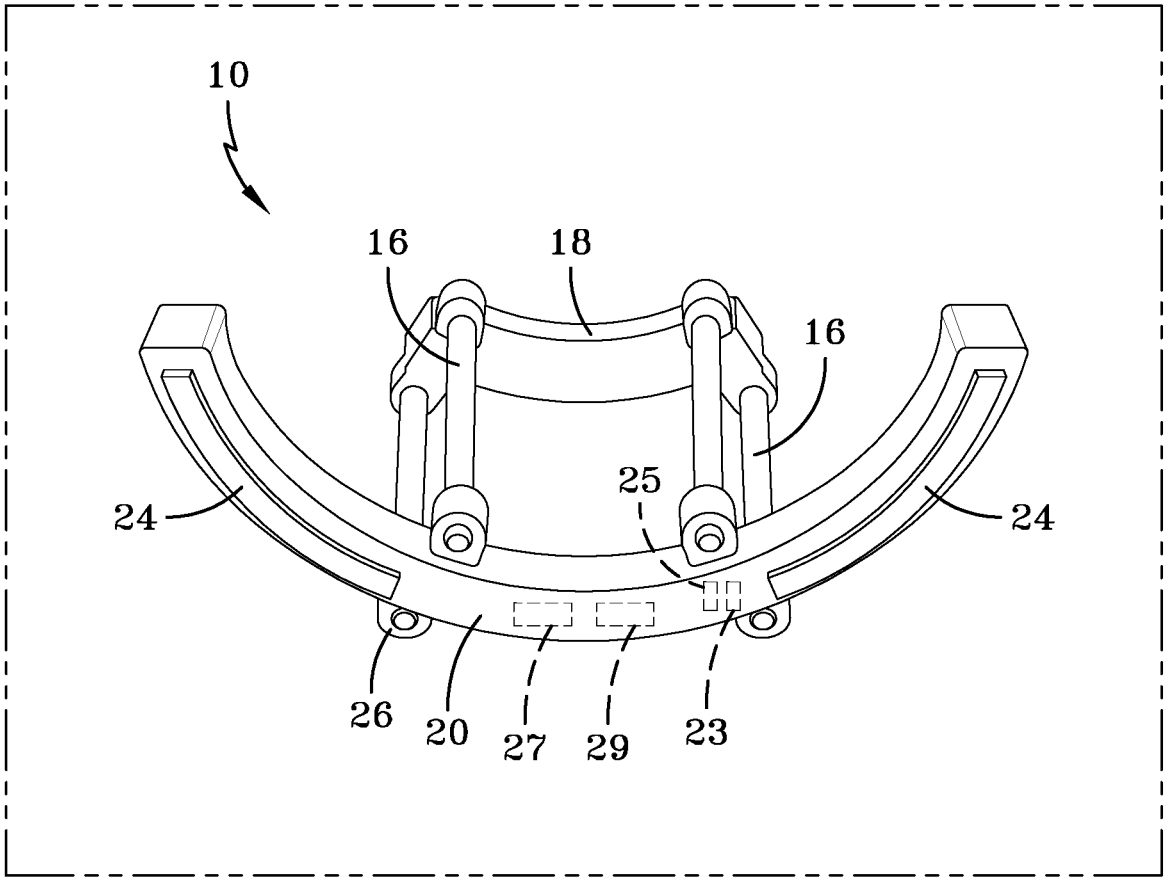
FIG. 2 illustrates another perspective view of the device of FIG. 1, wherein the device is not attached to a bow scope.
Figure 3:
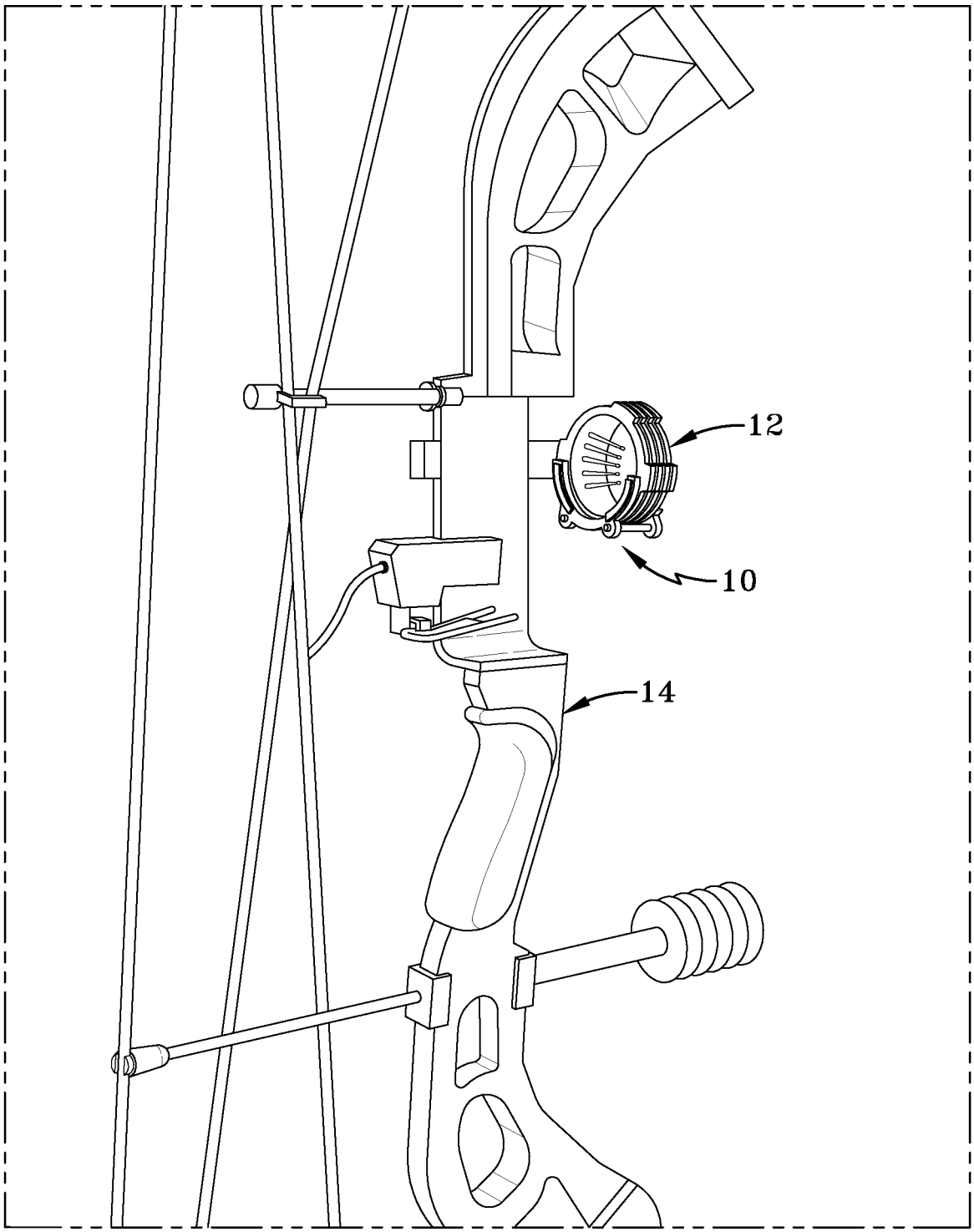
FIG. 3 illustrates a perspective view of a compound bow having the scope of FIG. 1 with the device of FIG. 1 attached thereto.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Referring now to FIGS. 1-3 and 10-13, an exemplary device 10 for promoting bow accuracy is shown. The device 10 may also assist a user in setting up a sight on one's bow, and with tuning one's bow. The device 10 may include a first portion 20 and a second portion 18. The first portion 20 may be positioned in front of the second portion 18, and may be spaced apart therefrom. One or more shafts 16 may extend between the first 20 and second 18 portions to link the first 20 and second 18 portions to one another, and retain the portions 18, 20 with respect to a scope 12. The shafts 16 may comprise screws (e.g., a fastener shank extending from a fastener head, and a fastener threaded portion located beyond the fastener shank) (e.g., fastener heads 31 are visible in FIG. 10). Alternatively, or additionally, one or more clips, bands, ties, latches, and/or other members may be employed to promote securement of the first 20 and second 18 portions opposite one another. The first portion 20 may include receivers 26 configured with an aperture for receiving a first end of the shaft 16, and the second portion 18 may include receivers 26 configured with an aperture for receiving a second end of the shaft 16.

The area of the shaft 16 proximate to either end may include a plurality of threads adapted to engage corresponding threads of the aperture of the receiver 26 to secure the shaft 16 between the first 20 and second 18 portions, and to bring in the first 20 and second 18 portions close enough to one another to secure each to the scope 12. Rotation of the shaft 16 may cause said engagement of opposing threads. Rotation of the shaft 16 may be actuated by a screwdriver or similar device (e.g., by engaging a fastener head formed to the shaft 16 using the screwdriver). The first portion 20 may extend beyond the receivers 26 to provide a pair of wings. Each wing of the first portion may include a light 24. The second portion 18 and a substantial amount of the first portion 20 may comprise metal, although such is not required. The second portion 18 is preferably smaller than the first portion 20. Each portion 18, 20 is not limited to any particular size or shape. The device 10 may be miniature in size, such as to minimize the amount of weight added to the bow 14.

The light 24 on the left side of the first portion 20 may illuminate red (or amber) when the bow 14 is tilted to the left away from true vertical axial alignment. The light 24 on the right side of the first portion 20 may illuminate red (or amber) when the bow 14 is tilted to the right away from true vertical axial alignment. In this particular embodiment, where either light 24 illuminates red (or amber), the archer is made aware that the bow 14 is not oriented properly, and thus the archer should not yet release the arrow (not shown). The more canted from true vertical axial orientation the bow 14 is, the brighter the light 24 may illuminate. When one light 24 illuminates red (or amber), the other light 24 may not illuminate, making it clear to the archer which direction the bow 14 is improperly canted to.

At least one light (and preferably each light) 24 may illuminate green when true vertical axial alignment is achieved. Green lights 24 may indicate to the archer that the arrow is ready to be released. The green lights 24 may assist the archer in focusing on one's target and maintaining proper positioning of the bow 14. Although green and red (or amber) light are preferred, any number of different light colors and/or other forms of indication (e.g., flashing, symbols) may be provided without departing from the scope of the present invention. The lights 24 may comprise LEDs. The LEDs may be digital LEDs. The LEDs may extend around the lower half of the front of the scope 12 on each side of the first portion 20. The lights 24 may specifically comprise LED bars and/or light guides. Movement of the bow 14 may activate a flashing sequence of the LEDs when the bow 14 is brought to a vertical orientation that is within a certain number of degrees (e.g., about 10 degrees) plus or minus the true vertical axial orientation. Where the bow is canted more than a certain number of degrees (e.g., about 10 degrees) from true vertical axial orientation, the lights 24 may automatically shut off (i.e., inactivate/deenergize). Where the lights 24 have been automatically shut off, the lights 24 may automatically be reactivated when the bow 14 is realigned vertically within a certain number of degrees (e.g., about 20 degrees—there may be a small margin of error, such as, for example, plus or minus 3 degrees) of true vertical axial orientation. The present invention is not limited to any particular type or number of lights, or any particular method of indicating distance away from true vertical axial alignment.

Figure 14:
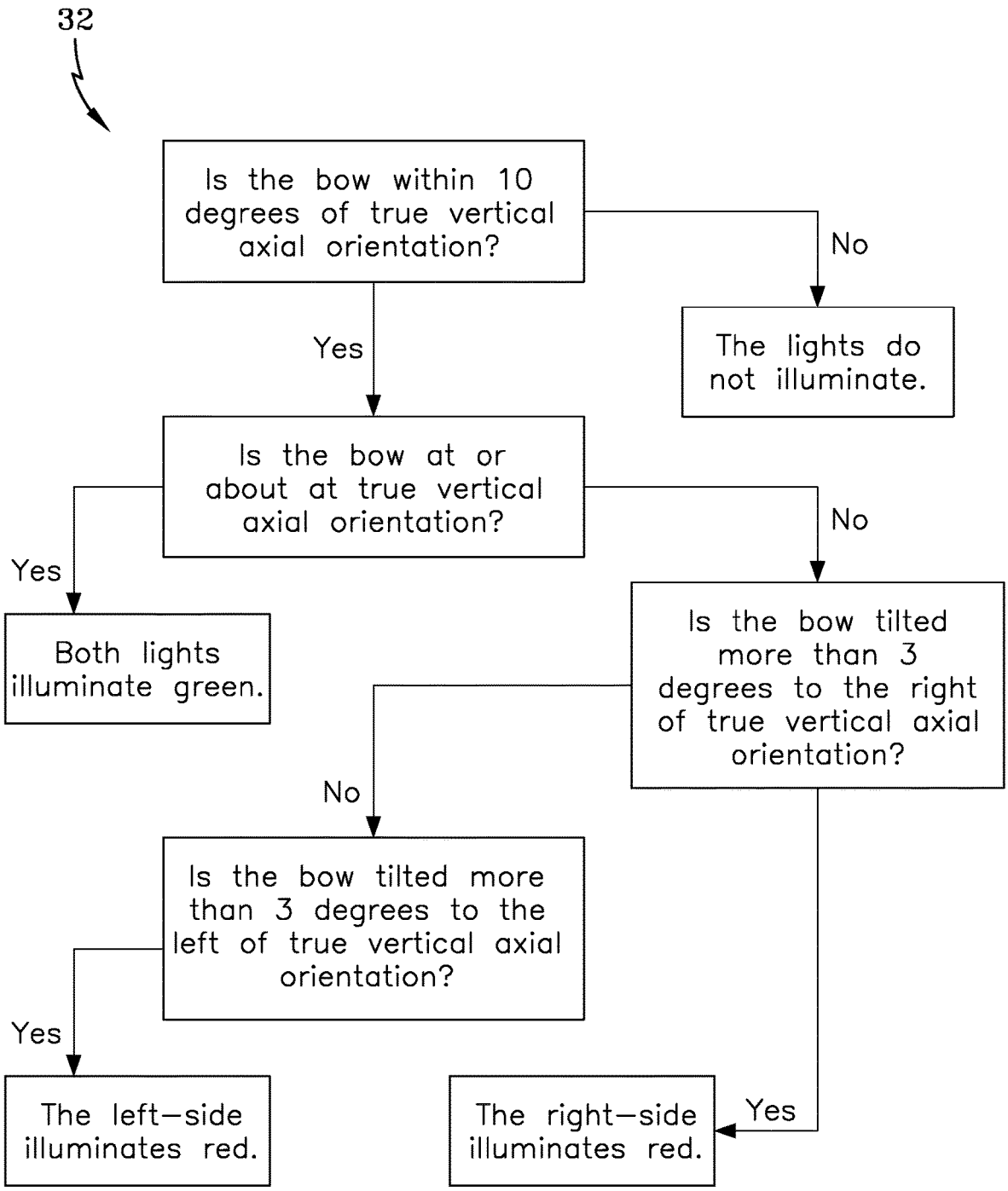
FIG. 14 illustrates exemplary logic for lighting the device of FIG. 1.

In the example shown, the lights 24 illuminate green to provide a clear visual sign that the bow 14 is in true vertical axial orientation. Exemplary logic 32 for the device 10 is shown in FIG. 14. Referring back to FIGS. 1-3 and 10-13, in the example shown, the archer is not required to take one's eyes off the target to recognize that the lights 24 are illuminating a particular color. This ensures to the user that one's shot is to be directed at the target indicated by the scope 12 (with higher accuracy and precision compared to using the bubble spirit level 22). Vertical orientation of the bow 14 may be indicated by the lights 24 regularly after a certain amount of time has passed (e.g., about every two seconds) (e.g., to help the archer stay focused on one's shot execution sequence). The device 10 may promote proper leveling even for inexperienced archers, and may provide higher success in the field for all archers (e.g., especially for archers hunting or target shooting from non-level surfaces, such as a non-level tree stand, a slope, mountain side, or a hill). Although a bubble spirit level 22 is shown at the scope 12 in this example, the bubble spirit level 22 is not required/may be removed.

A sensor may be provided at the device 10 (e.g., inside the first portion 20). The sensor may be an electronic sensor (27 in FIG. 2). The sensor may be configured to detect the particular angle of the bow, and communicate to a controller (29 in FIG. 2) (e.g., involving a processor) the magnitude of the tilt of the bow from true vertical axial alignment. Where the sensor detects an angle beyond a particular threshold (e.g., more than about 3 degrees in either direction), the sensor may communicate this to the controller, and the controller may cause the appropriate light 24 to illuminate red (or amber) (e.g., continuously while the bow is not level). The controller 29 may be a microcontroller centrally located between lights 24 of an LED wing array. The controller 29, lights 24, and sensor 27 may be part of a low power electronics module of the device 10, which may utilize one or more batteries as a power source.

Where the sensor detects that the bow is positioned at about true vertical axial orientation, the sensor may communicate this to the controller, and the controller may cause each or either light 24 to illuminate green (e.g., continuously while the bow is level). The lights 24 may automatically stop illuminating after a certain amount of time. The lights 24 may illuminate after briefly turning off to verify proper bow positioning (or lack thereof). The lights 24 may also only illuminate if the controller determines that the archer is preparing to take a shot (e.g., when an arrow is positioned at the bow-a sensor in communication with the controller, such as an optical sensor at an arrow shelf of the bow, may be provided to determine the presence of an arrow). The sensor(s) may include an accelerometer, gyroscope, optical sensor, some combination thereof, or the like. The sensor for detecting bow angle is preferably configured to detect small variations in vertical alignment. The sensor and/or controller may include and/or be linked to a microelectronics module, preferably having a replaceable lithium battery. The battery may be rechargeable. The present invention is not limited to any particular type or number of sensors, control processors, and/or power sources.

The device 10 may be capable of detecting changes in vertical orientation as small as 1/10 of a degree, by way of non-limiting example. The device 10 may include a brightness adjustment feature (23 in FIG. 2). For example, in low light situations, a user may interact with the brightness adjustment feature to decrease brightness of the lights 24. The device 10 may include an illumination duration feature (25 in FIG. 2) (e.g., for long holds and shot timing). For example, the lights 24 may, by default, illuminate for several seconds (e.g., 8-10 seconds). A user may adjust the illumination duration by interacting with the illumination duration feature. The brightness adjustment feature and/or illumination duration feature may comprise one or more buttons, dials, digital display screens, some combination thereof, or the like. These features may be located at the device 10, and/or may be external to the device 10. For example, these feature may be available by way of a software application that a user may interact with using a computing device remote from the device 10.

In FIGS. 1, 3 and 10-13, the device 10 is shown affixed to a scope 12 of a compound bow 14. Device 10 components, such as, for example, the number, length and/or orientation of each shaft 16 and the number, size, and/or orientation of each receiver 26 may be varied to accommodate any particular compound bow scope/sight. A lower portion of the scope 12 may be secured between the first 20 and second 18 portions of the device 10 to affix the device 10 to the scope 12. This particular configuration may be achieved by positioning each shaft 16 through a first aperture of a receiver 26 on either side of the device 10, and rotating a threaded portion of the shaft 16 through a second aperture of a receiver 26 opposite of the first aperture. The second aperture may include threads adapted to receive opposing threads of the shaft 16 to secure the shaft 16 to the second aperture. Shafts 16 may be located above and below the lower portion of the scope 12 to allow for each portion 18, 20 of the device 10 to be constricted and secured to the lower portion of the scope 12. The corresponding threads of the device 10 may allow for the first 20 and second portion 18 to be positioned any number of distances from one another, such as to permit the device 10 to be connected to any number of different scopes.

Figure 4:
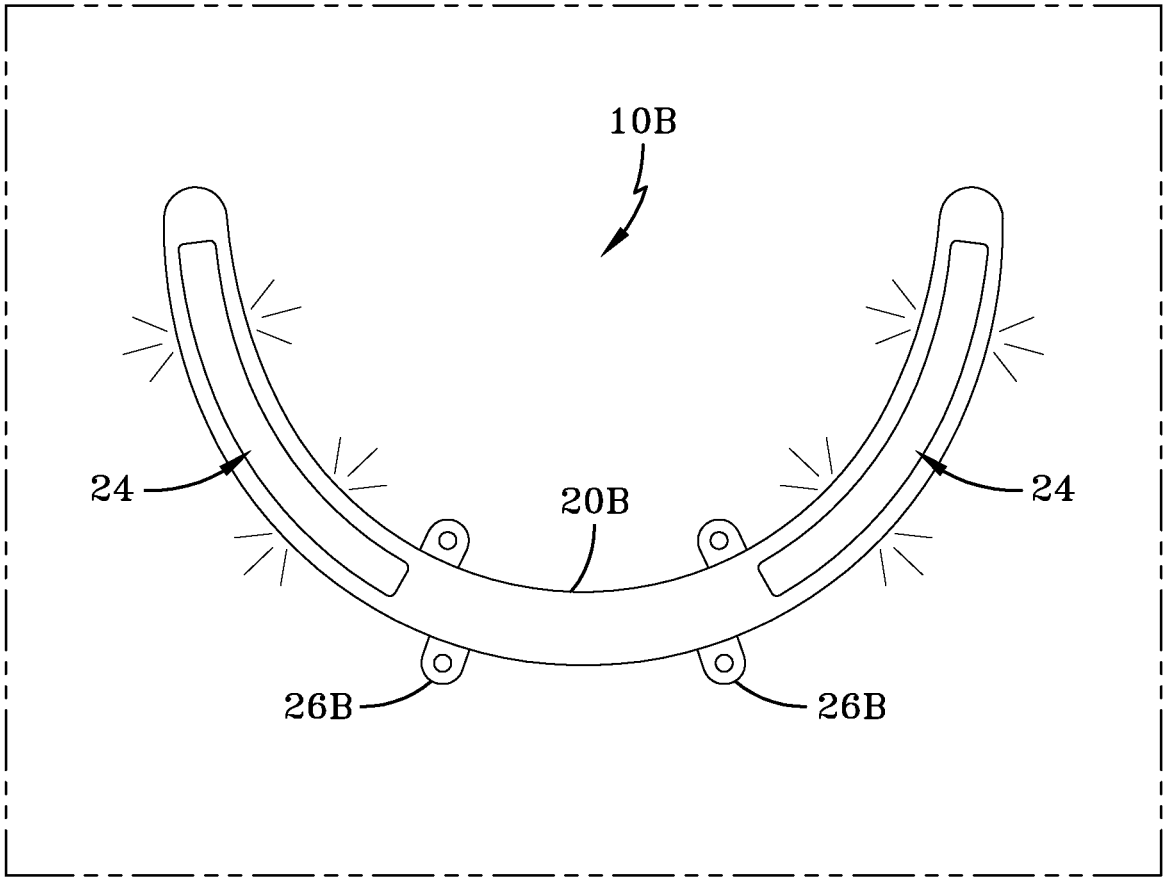
FIG. 4 illustrates a front, elevational view of another exemplary device for promoting bow accuracy of the present invention.
Figure 5:
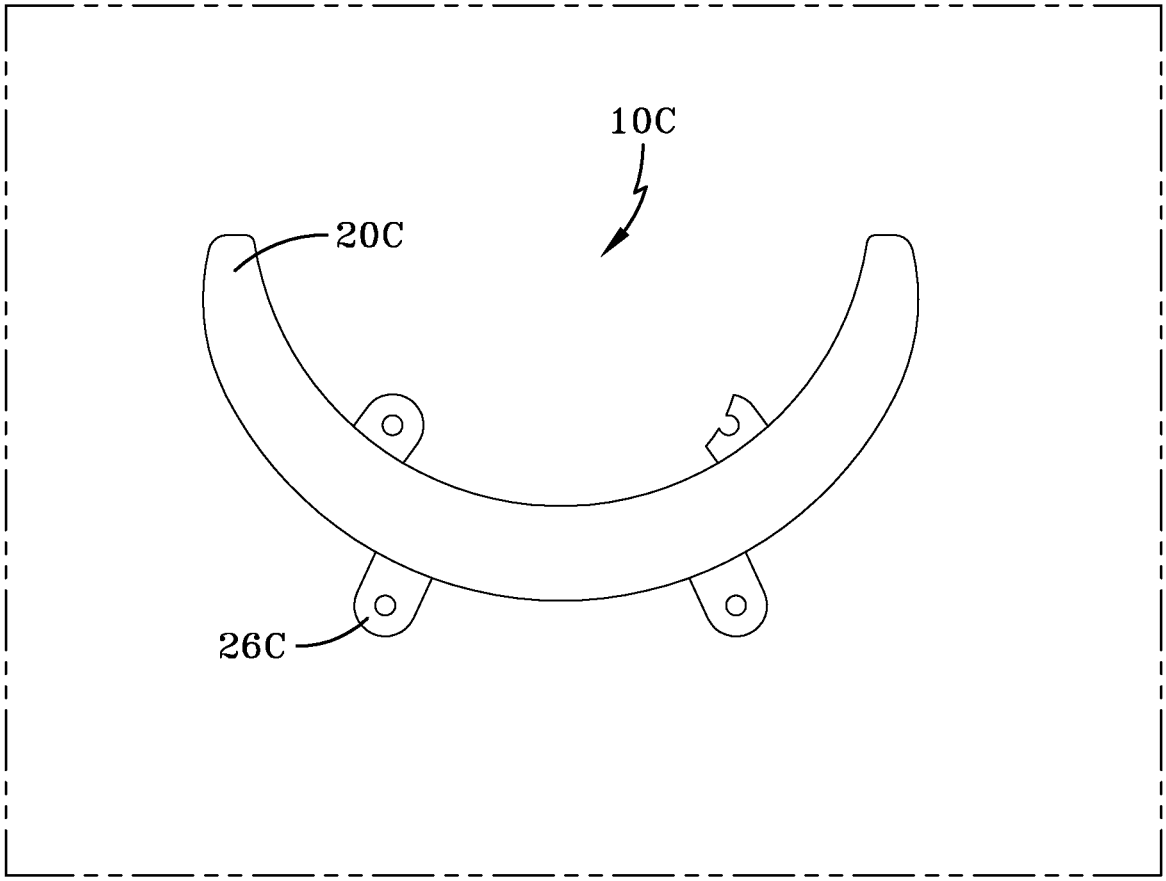
FIG. 5 illustrates a front perspective view of a front portion of yet another exemplary device for promoting bow accuracy of the present invention.
Figure 6:
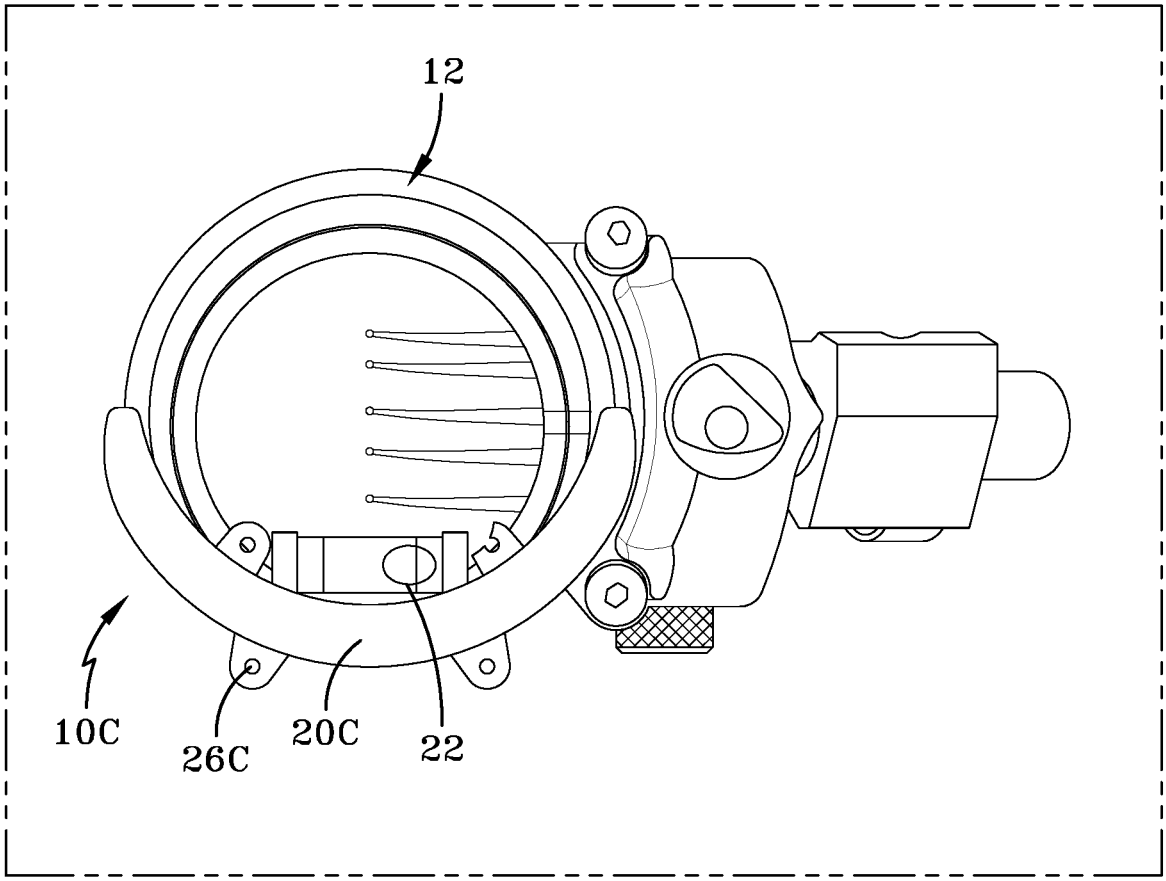
FIG. 6 illustrates another front perspective view of the device of FIG. 5, wherein the device is attached to a bow scope.
Figure 7:
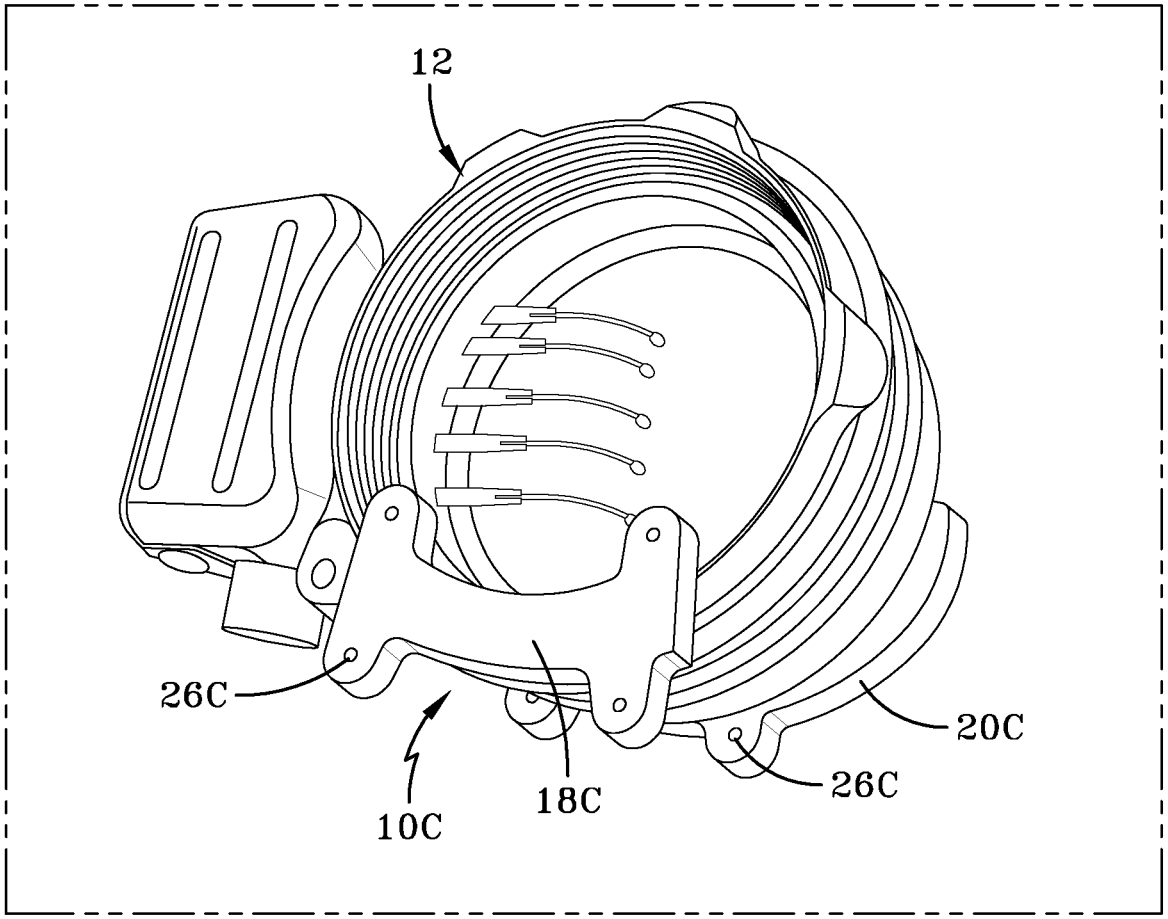
FIG. 7 illustrates a rear perspective view of the device of FIG. 6, the device attached to the bow scope of FIG. 6.
Figure 8:
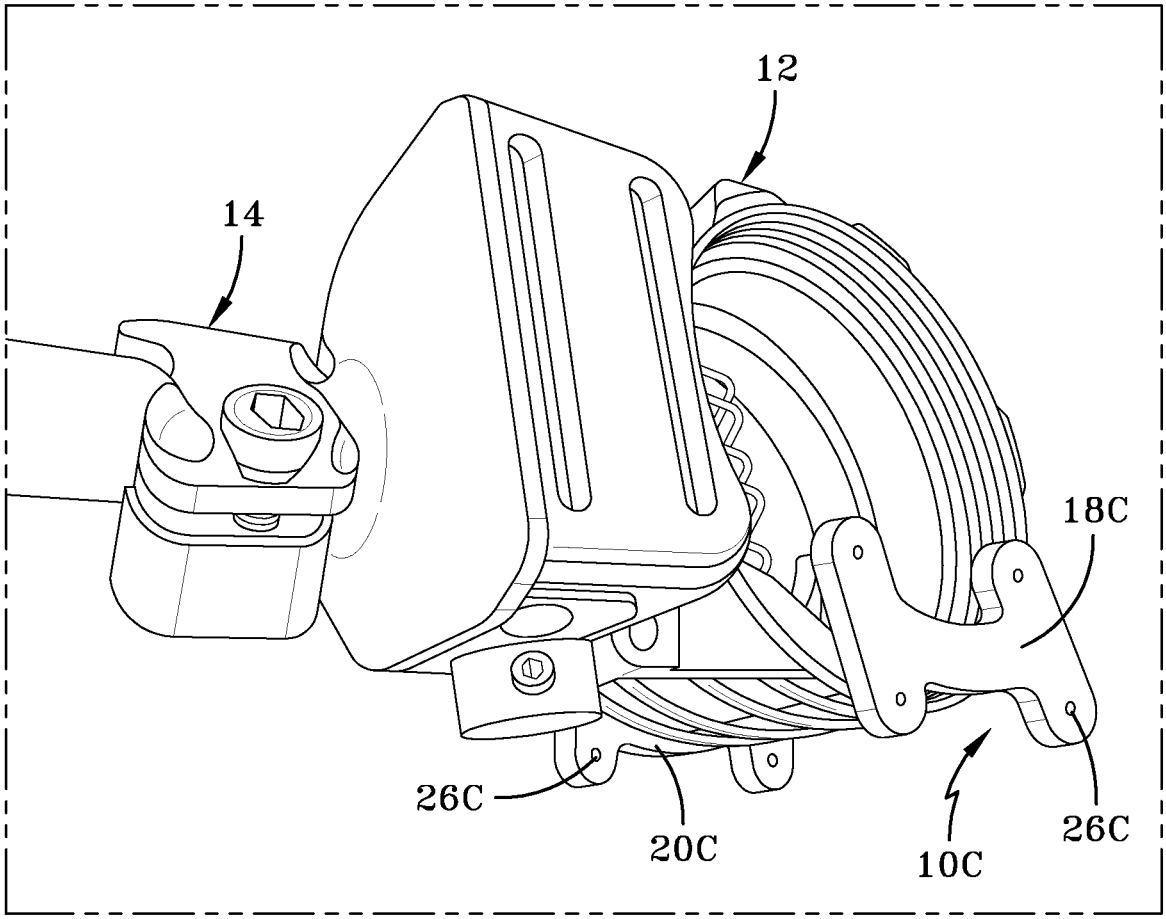
FIG. 8 illustrates another rear perspective view of the device of FIG. 6, the device attached to the bow scope of FIG. 6.
Figure 9:
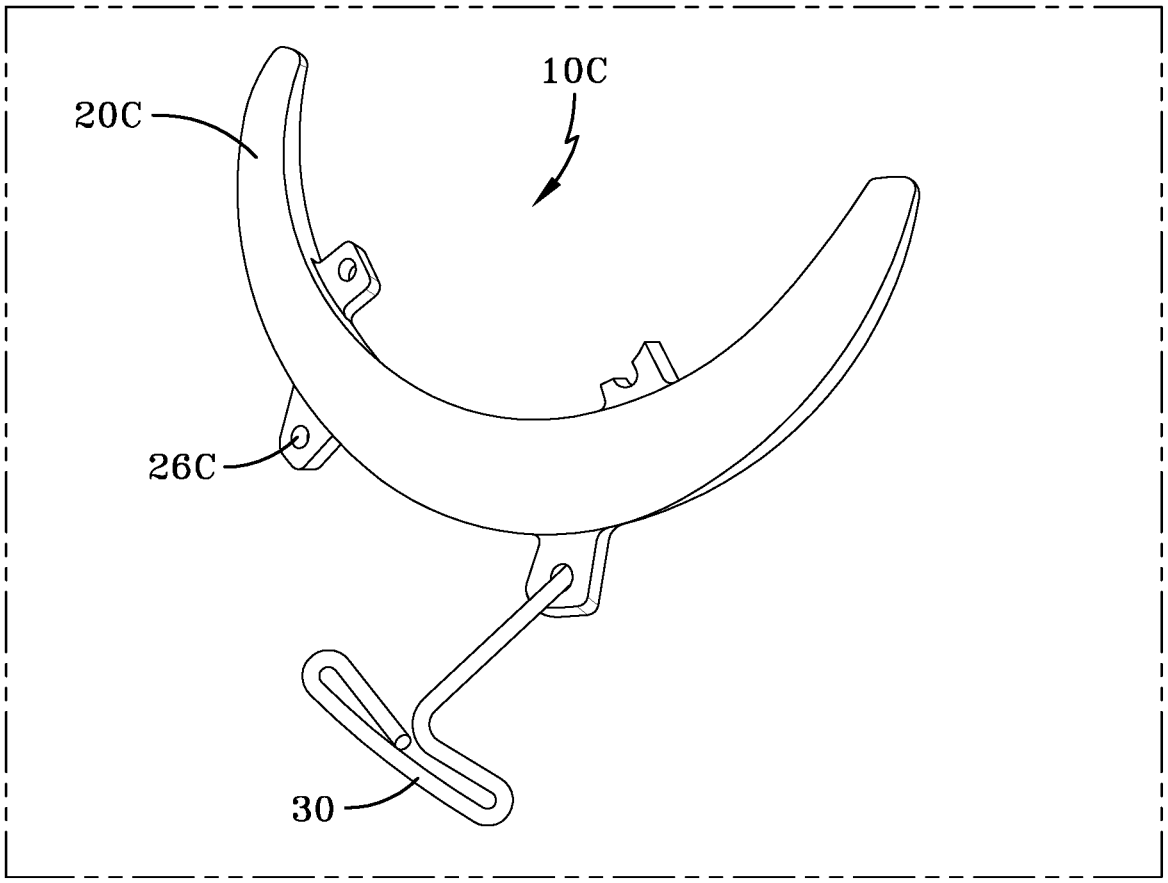
FIG. 9 illustrates another perspective view of the front portion of the device of FIG. 5.
Figure 10:
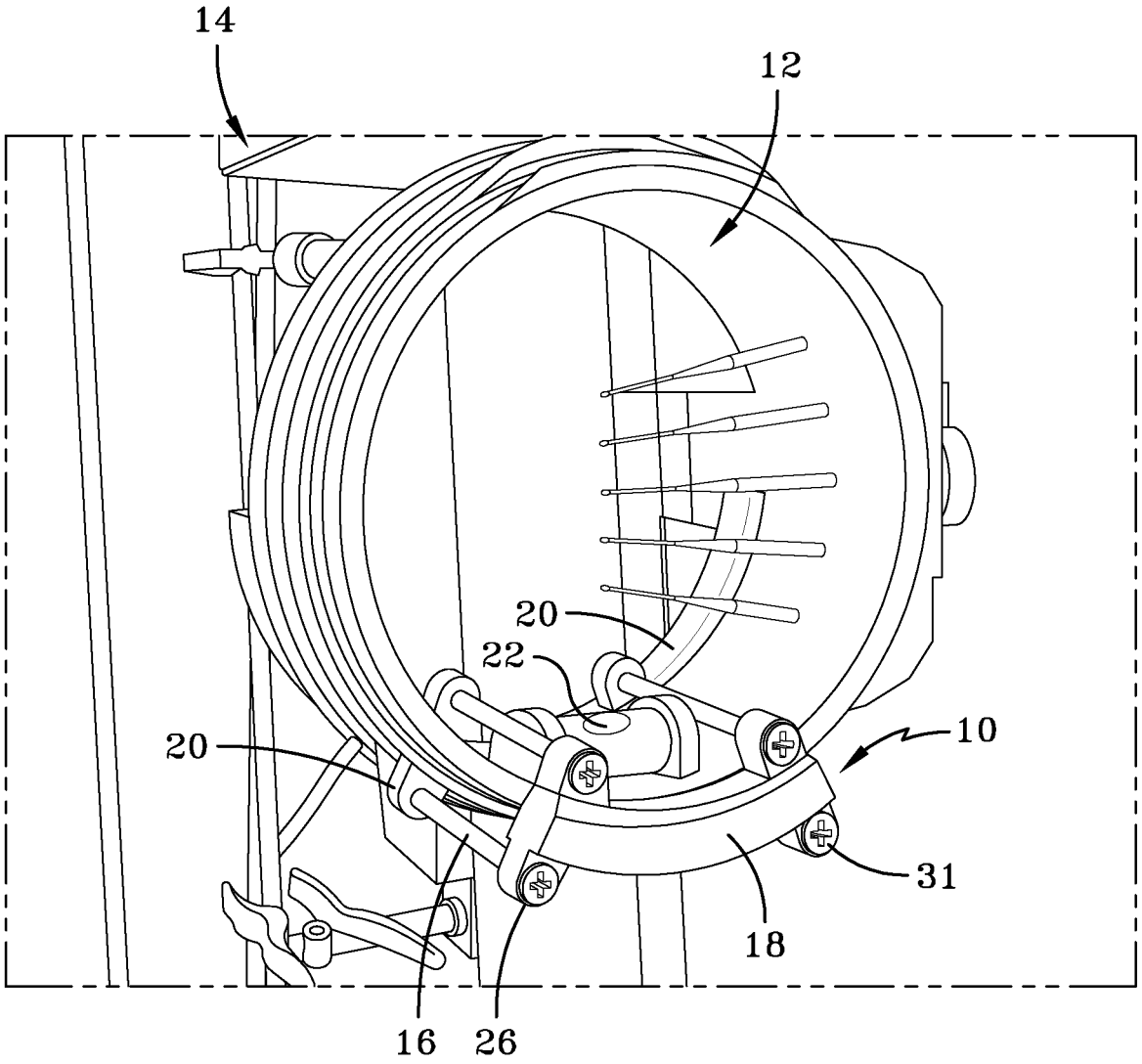
FIG. 10 illustrates a rear perspective view of the device of FIG. 1, attached to the bow scope of FIG. 1.
Figure 11:
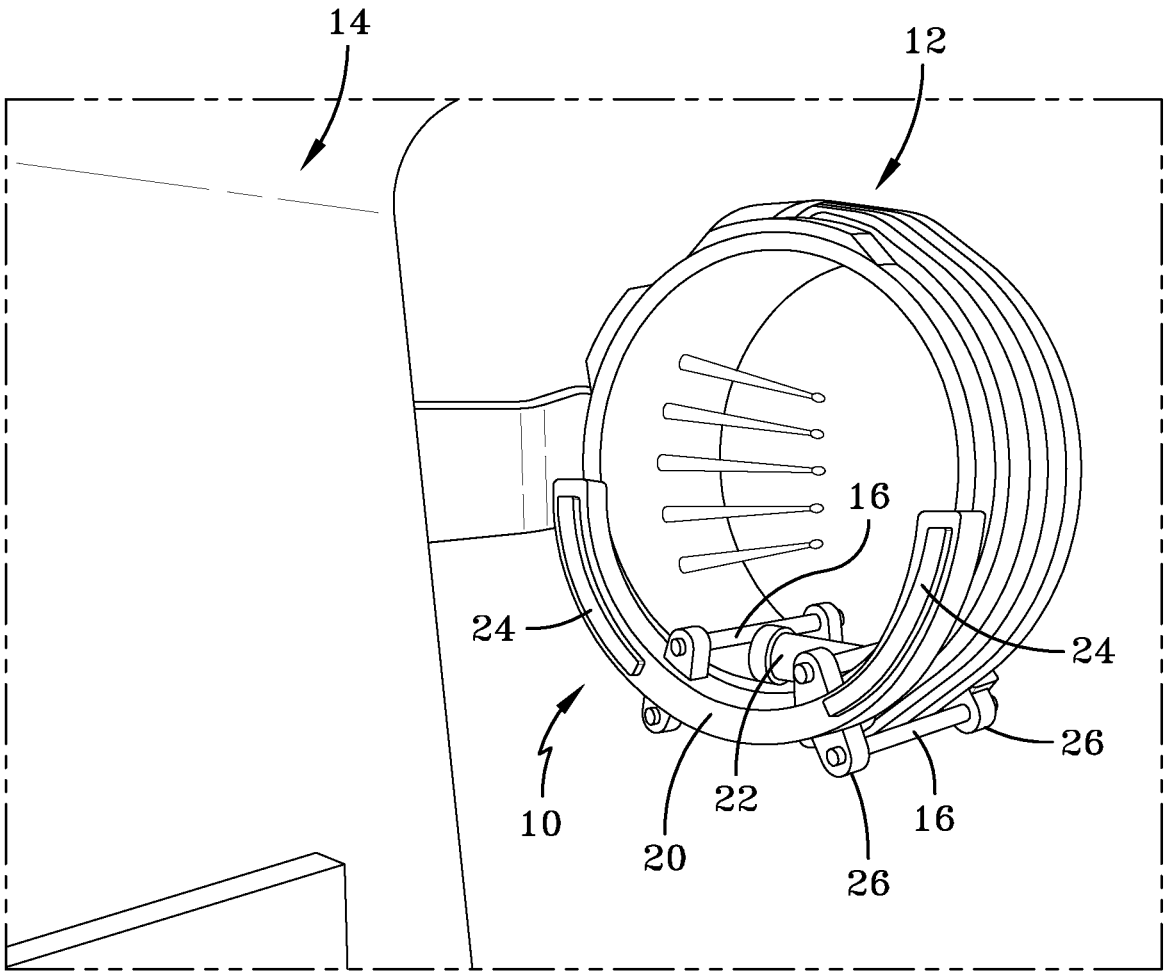
FIG. 11 illustrates a front perspective view of the device of FIG. 1, attached to the bow scope of FIG. 1.
Figure 12:
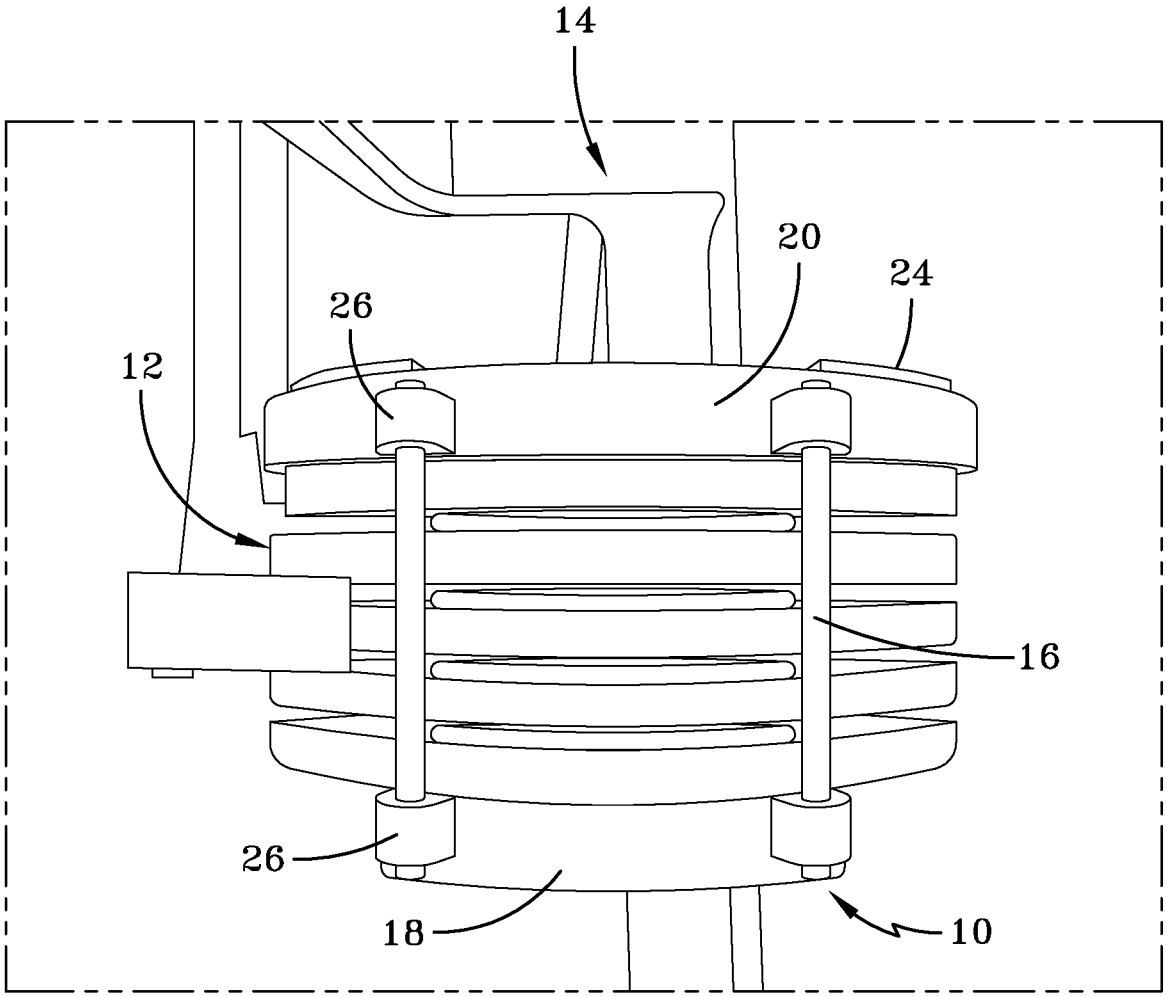
FIG. 12 illustrates a bottom perspective view of the device of FIG. 1, attached to the bow scope of FIG. 1.
Figure 13:
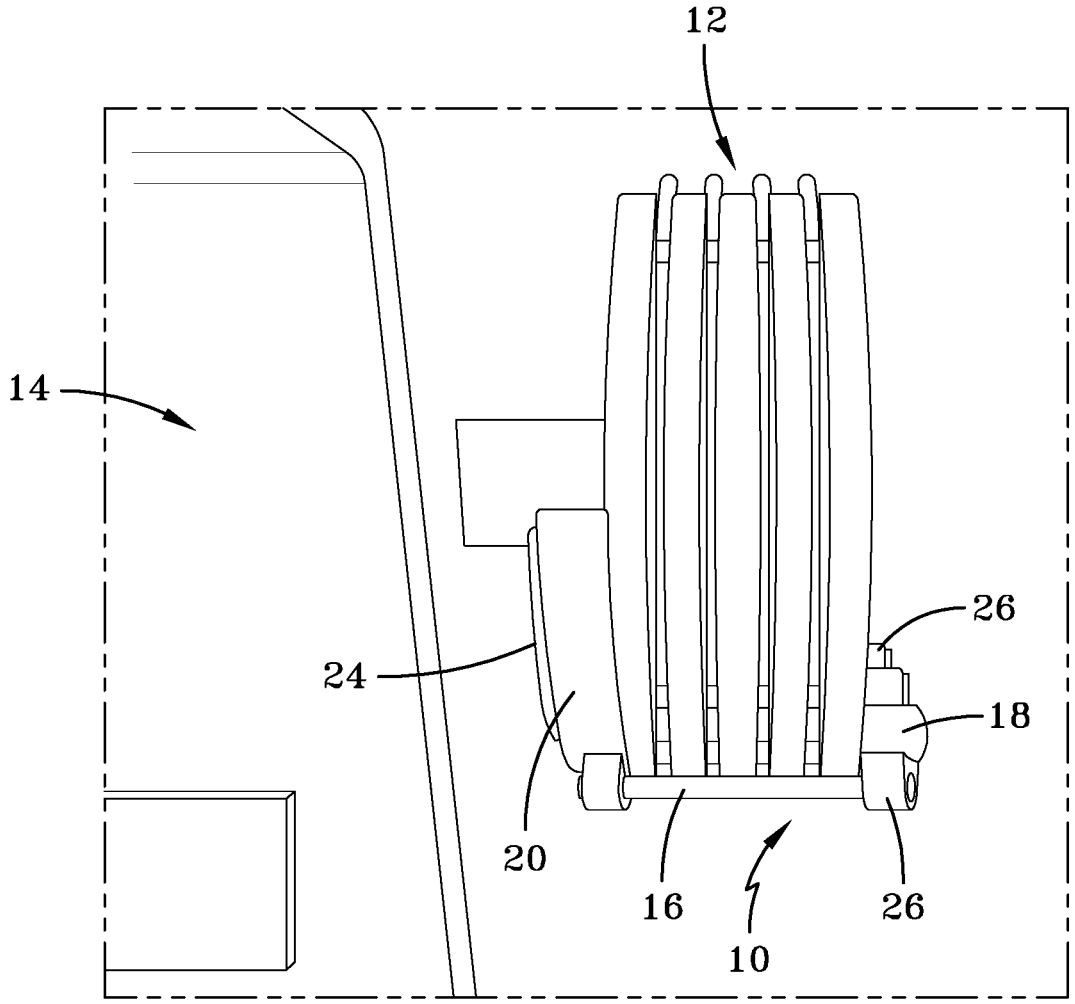
FIG. 13 illustrates a right-side perspective view of the device of FIG. 1, attached to the bow scope of FIG. 1.

Referring to FIG. 4, a front portion 20B of another exemplary device 10B for promoting bow accuracy is shown. Here, a plurality of receivers 26B each include an aperture for receiving a shaft (not shown). A pair of lights 24 are positioned at each side of the front portion 20B. The light 24 on the right side of the device 10B may illuminate red (or amber) when the bow is tilted more than 3 degrees to the right of true vertical axial orientation, and the light 24 on the left side of the device may illuminate red (or amber) when the bow is tilted more than 3 degrees to the left of true vertical axial orientation. Each light 24 may illuminate green when the bow is at or about at true vertical axial orientation. The angle of tilt or lack thereof required to cause either light 24 to illuminate a particular color may be varied without departing from the scope of the present invention. Furthermore, an exemplary device for promoting bow accuracy may be provided in any number of different shapes, dimensions, sizes, configurations, colors, or the like, e.g., to accommodate any number of different sights/scopes of any number of different bows.

Referring now to FIGS. 5-9, another exemplary device 10C for promoting bow accuracy is shown. Here, the device 10C includes a first portion 20C having receivers 26C for receiving shafts (not shown), and a second portion 18C having receivers 26C for receiving shafts. The shafts may engage the first 20C and second 18C portions to cause each portion 18C, 20C to be secured to a scope 12 of a bow 14. A lower portion of the scope 12 may be in contact with and positioned between the first 20C and second 18C portions. A spirit bubble level 22 may already be positioned at the scope 12, but the device 10C here may render the spirit bubble level 22 obsolete such that it is an optional feature. The level 22 may be configured for removal at the option of the user. Each side of the first portion 20C may extend to about a midpoint of the scope 12.

A screwdriver 30 or similar tool may be used to engage a fastener head (not shown) of each shaft to, e.g., adjust the distance between the first 20C and second 18C portions, cause each portion 20C and 18C to be securely connected to the scope 12, cause each portion 20C and 18C to be disconnected from the scope, some combination thereof, or the like. In this particular embodiment, the device 10C is adapted to receive four screws (two above the bottom portion of the scope, and two below), each screw running from the second portion 18C (where the fastener head of the screw is located) to the first portion 20C. In certain other embodiments, it is not required that each screw run from the second portion where the fastener head is located to the first portion. Also, the number and type of shafts in other embodiments may be varied.

Furthermore, in this particular embodiment, lights have not yet been positioned at the device 10C. It will be apparent to one of ordinary skill in the art that any number of different lights may be positioned at or on any number of different locations of an exemplary device without departing from the scope of the present invention. Exemplary device 10C material may include metal, plastic, composite material, acrylic, some combination thereof, or the like. Exemplary material provided to form the device 10C are preferably capable of withstanding the rigors of the outdoors (e.g., harsh weather conditions). An exemplary device is configured to withstand any number of different conditions (e.g., harsh weather conditions) without becoming dislodged from a bow scope/sight. The present invention is not limited to any particular material composition, configuration of parts, and/or number of parts.

Referring back to FIGS. 10-13, various parameters regarding device 10 operation may be user controllable by way of a software application. The software application may be fully programable, and executed and interacted with using a computing device such as a smart phone. The device 10 may initially operate according to a default setting, but aspects of the device 10 may be adjusted (e.g., remotely and digitally) by a user. For example, a user may, by way of a smart phone application, dictate specific tilt angle (or lack thereof) magnitude required to cause the lights 24 to illuminate red, amber, green, and/or another color. The application may allow for a processor to communicate instructions to the sensor and/or controller of the device 10. Other user controllable settings may include, for example, light color, illumination duration (e.g., may be adjusted for long holds and various different shot timing), illumination type (e.g., continuous versus blinking), illumination intensity (i.e., brightness), on and off settings for the device 10 (e.g., may be provided by app in addition or alternative to an on and off switch located directly on the device 10), some combination thereof, or the like.

Figure 15:
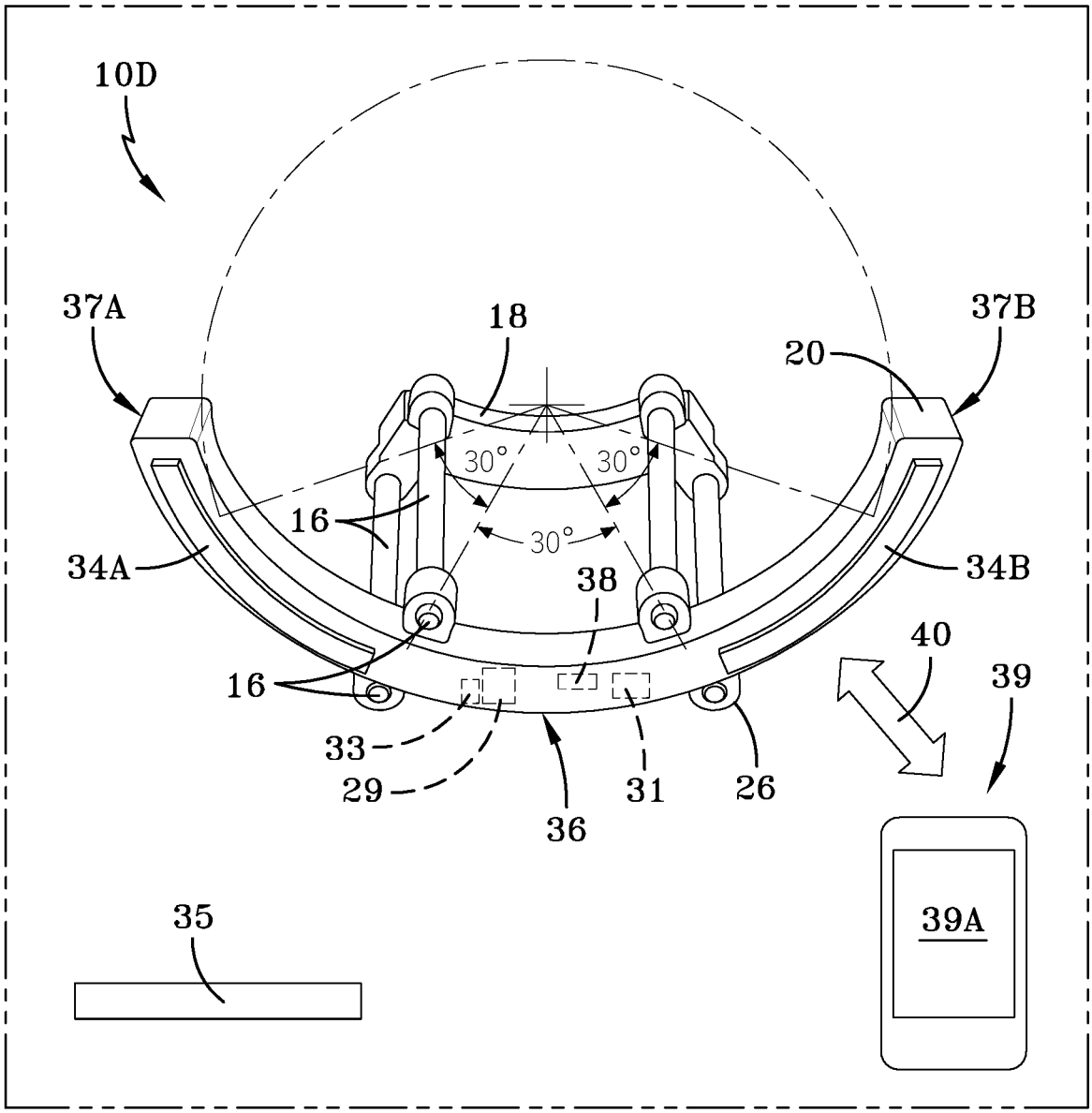
FIG. 15 illustrates a front perspective view of another exemplary device for promoting bow accuracy of the present invention.

Referring now to FIG. 15, an exemplary device 10D for promoting bow accuracy having lights 34A-B spaced approximately 30 degrees from one another is shown. The device 10D may include a first 20 and second 18 portion secured to one another by one or more shafts 16 (and/or other connecting members), which may each be secured by a receiver 26. Each portion may comprise a solid member having a plurality of flat and/or curved surfaces. The first portion 20 may include a first wing 37A, a second wing 37B, and a central section 36 spanning the distance between the first 37A and second 37B wings. In this particular embodiment, a first light 34A is located at a front face of the first wing 37A, and a second light 34B is located at a front face of the second wing 37B. Each light 34A-B may span substantially the length of the respective wing 37A-B. Each wing 34A-B may be configured to extend adjacent to a length of a sight defining about 30 degrees of the circumference of the sight (when the device 10D is connected to the bow sight). Each wing may extend approximately perpendicular to the shafts 16 of the device 10D, and may be positioned within an inner diameter of the scope (when viewed from a peep sight).

The device 10D may be configured to be positioned at the bottom of the sight. The central section 36 of the first portion 20 may also extend adjacent to a length of the sight defining about 30 degrees of the circumference of the sight (when the device 10D is connected to the bow sight). The central section 36 may be a portion of the device 10D that does not illuminate. Alternatively, the central section 36 may comprise a third light 35. One or more sensors and/or controllers may be positioned at the device 10D (e.g., internally within the first portion 20), and may be configured to regulate illumination of the first 34A, second 34B and/or third 35 lights. The first 34A and second 34B lights may be configured to emit amber light (e.g., the first light 34A may emit amber light when the bow is tilted to the left, and the second light 34B may emit amber light when the bow is tilted to the right), and the third light 35 may be configured to emit green light (e.g., when the bow is level), though such is not required. Alternatively, one or both of the first 34A and second 34B lights may also illuminate green when the bow is properly oriented. Each light may comprise an LED (light emitting diode) (e.g., a single-color LED). The first portion 20 having the wings 37A-B and central section 36 may cover a length of the sight defining about 90 degrees of the circumference of the sight (when the device 10D is connected to the bow sight). The electronic components of the device 10D (e.g., lights, sensors, controllers, some combination thereof, or the like) may each be located at the first portion 20, though such is not required. In this particular embodiment, the lights 34A-B are configured to be, when illuminated, visible through a bow string peep sight. A user may differentiate the first 34A and second 34B lights from one another when either is illuminated. The housing of the device 10D (and particularly the wings 37A-B) may be flexible to accommodate a variety of different scope inner diameters. As a non-limiting example, the device 10D may be used with a scope having an inner diameter of about 45 mm to about 51 mm. It will be apparent to those of ordinary skill in the art that an exemplary embodiment is not limited to any particular sight/scope.

Figure 16:
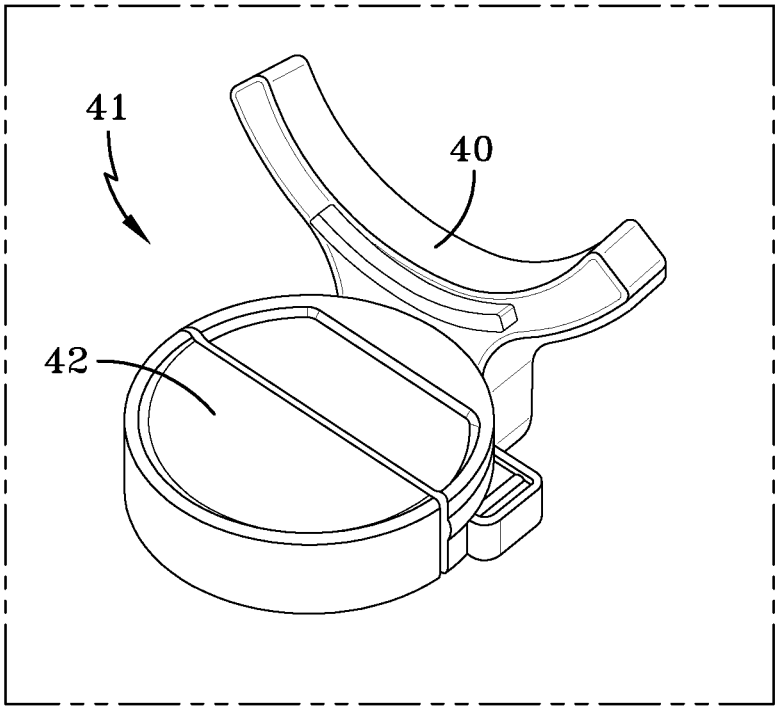
FIG. 16 illustrates a perspective view of an exemplary LED housing for the device of FIG. 15.
Figure 17:
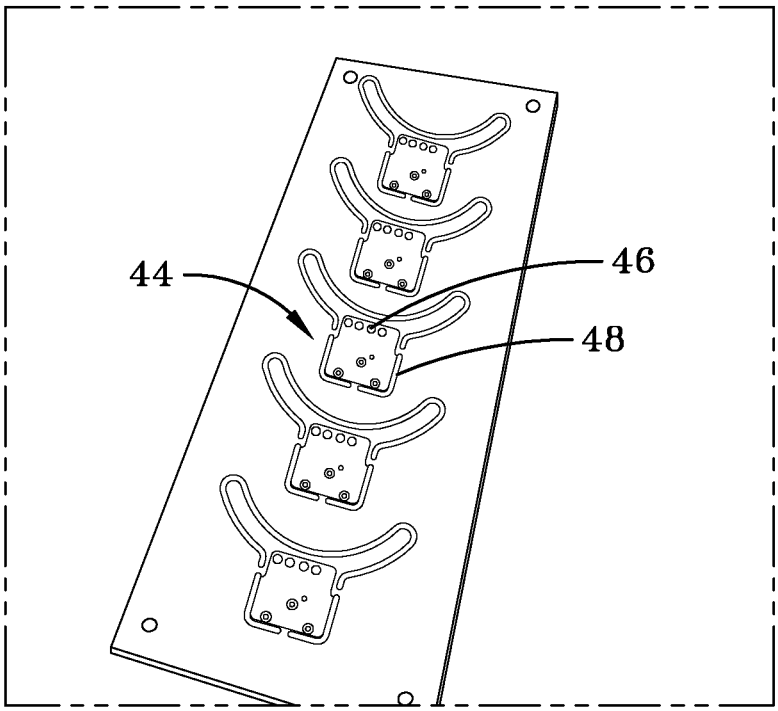
FIG. 17 illustrates a perspective view of an exemplary PCBA for the device of FIG. 15.

Referring now to FIGS. 16-17, an exemplary LED housing 41 and an exemplary PCBA (printed circuit board assembly) 44 for a device for promoting bow accuracy are shown. The LED housing 41 may include a first section 40 and a second section 42. The PCBA 44 may include a printed circuit board (PCB) 48 and assembled components 46. Referring to FIGS. 15-17, the PCBA 44 and LED housing 41 may be configured to be mounted onto a scope by compression. For example, the first portion 20 (e.g., having wings 37A-B, central section 36, one or more batteries, LEDs at wings 37A-B) may be mounted to the front of an outer surface of a scope, and the second portion 18 may be mounted to the rear of an outer surface of the scope (e.g., by screws, other fasteners, clips, clamps, some combination thereof, or the like). As a specific, non-limiting example, the device 10B may mounted to the bottom of a scope by way of a compression clipping mechanism involving one or more clips.

The PCBA 44 may permit a battery housing to be positioned under the scope (e.g., to minimize or prevent field of view interference by the power module of the device). Similarly, the PCBA 44 housing may be configured to prevent a user's view of a bubble level of a sight from being obstructed. The device 10D may be configured for the shafts 16 (e.g., mounting screws) to be secured outside of the bubble level of the sight (e.g., to allow the bubble level to be used as a centering feature). The PCBA 44 may regulate lighting of the device 10D. The first 34A and second 34B lights may emit amber light along a 30-degree length of a respective wing 37A-B. Alternatively, or additionally, one or more lights (e.g., LEDs) may be mounted with one or more light channels at the bottom on the PCB 48 (e.g., to allow for variable light intensity depending on, for example, the number of LEDs activated and/or power intensity). The PCBA 44 may be configured to allow for Bluetooth connection of the device 10D with a software application (e.g., to permit additional capabilities to be programmed to the device 10D for future applications, such as, for example, shot sequence position in a rolling memory loop, flash sequence programming, device 10D calibration, some combination thereof, or the like).

A multi-axis accelerometer 33 may be positioned at (e.g., within an interior of) the first portion 20 of the device 10D. The accelerometer 33 may be in electronic communication with a system controller 29 (e.g., a microcontroller). The system controller 29 may be configured with wireless communication capacity, such as, for example, Bluetooth Low Energy ("BLE") capability (e.g., to allow pairing of the device 10D and its controller 29 with a software application 39A). The software application 39A may be implemented on and/or executed by a computing device (e.g., a smart device such as smart phone 39) (e.g., to permit two-way data transmission 40). The accelerometer 33 may be configured to measure the bow angle away from true vertical (i.e., the angle of the bow to the right or left from the true vertical position). The accelerometer 33 may be accurate to within about 1/10 of a degree. When the accelerometer 33 determines the angle of the bow is within plus or minus approximately 2 degrees (to the right or left) from 0 degrees (the true vertical position), a system controller 29 may cause at least one light (e.g., 35) to illuminate green. When the accelerometer 33 determines the angle of the bow is greater than approximately 2 degrees to the left from 0 degrees (but less than or equal to approximately 20 degrees to the left), the system controller 29 may cause the first light 34A to illuminate amber. When the accelerometer 33 determines the angle of the bow is greater than approximately 2 degrees to the right from 0 degrees (but less than or equal to approximately 20 degrees to the right), the system controller 29 may cause the second light 34B to illuminate amber. The bubble in a spirit level (e.g., 22 in FIG. 11) may be located at the portion of the level opposite the illuminating light 34A-B (e.g., when the second light 34B illuminates amber, the bubble in the spirit level may be located on the left-hand side of the level).

When the accelerometer 33 determines the angle of the bow (to the left or right from 0 degrees) is greater than approximately 20 degrees, the system controller 29 may cause the lights 34A-B, 35 to automatically turn off (i.e., deenergize) and/or otherwise prevent the device 10D from illuminating (e.g., to indicate to a user that the bow is not ready for use and/or is in storage). After the lights 34A-B, 35 are shut off following positioning of the bow outside of plus or minus approximately 20 degrees from a true vertical position, a user may be required (e.g., per a logic sequence with an activation latency period of 1 second, or at least approximately 1 second) to place the bow within plus or minus approximately 20 degrees from the true vertical position to reactivate the lights 34A-B, 35 of the device 10D. The device 10D may include a photoelectric intensity adjustor 38 to regulate device 10D LEDs (e.g., causing lower intensity of the LEDs when ambient light is lower, and higher intensity of the LEDs when ambient light is higher to promote visibility of the lights 34A-B, 35).

A logic sequence may dictate that when the first 34A or second 34B light illuminates, the illumination may last for up to a minute (e.g., to show vertical orientation during use) before the light 34A or B is automatically shut off (e.g., to reduce device 10D power usage). The device 10D may be powered by at least one battery 31 (e.g., coin cell CR2032, and/or a similar battery). The device may also automatically shut off when no movement is detected for an amount of time (e.g., about a minute), and/or when only minimal movement in any direction (e.g., left, right, front, back) is detected for an amount of time (e.g., about a minute). When one or more lights are automatically shut off, said lights may remain shut off until subsequent movement is sensed by a device sensor to reinitiate bow orientation evaluation by the accelerometer 33, and related lighting. Reactivation of device 10D lights 34A-B, 35 may occur when movement of at least about 1/10 of a degree (to the right or left) occurs, at which point the accelerometer 33 may again evaluate bow orientation to dictate device 10D lighting. The aforementioned logic sequences may be implemented by way of system software.

Where any component discussed herein are implemented as software, any of a number of programming languages may be employed such as, for example, C, C++, C#, Objective C, Java®, JavaScript®, Perl, PHP, Visual Basic®, Python®, Ruby, Delphi®, Flash®, LabVIEW, or the like. Software components may be stored to a memory, and may be executable by one or more processors. Examples of executable programs include, for example, a program that may be translated into machine code in a format that may be loaded into a random-access portion of a memory and run by one or more processors, source code capable of being loaded into a random-access portion of a memory and run by one or more processors, some combination thereof, or the like.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Although embodiments specifically illustrated and described herein are discussed with reference to compound bows, the present invention is not limited to compound bows, and may have applicability outside of archery. Although embodiments specifically illustrated and described herein are discussed with reference to lights, other indicators may additionally or alternatively be provided without departing from the scope of the present invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A device for promoting bow accuracy, the device comprising:

a first member configured to be positioned against a first portion of a bow sight, the first member having a plurality of lights located thereat;

a second member configured to be positioned against a second portion of the bow sight behind the first portion;

a third member shaped to secure the first and second members opposite one another at the bow sight;

a sensor configured to evaluate a vertical orientation of the bow;

a microcontroller configured to regulate illumination of the plurality of lights based on one or more measurements of the sensor;

wherein a first light of the plurality of lights is configured to illuminate when the bow is tilted beyond a threshold angle to the left from a true vertical position;

wherein a second light of the plurality of lights is configured to illuminate when the bow is tilted beyond a threshold angle to the right from the true vertical position; and wherein the microcontroller is configured to deenergize the plurality of lights when the bow is oriented beyond about 20 degrees from the true vertical position.

2. The device of claim 1, wherein the microcontroller is configured for wireless communication with a software application executed by a computing device to allow for two-way data transmission between the microcontroller and the computing device.

3. The device of claim 2, wherein the microcontroller is configured for Bluetooth Low Energy (BLE) communication with the computing device.

4. The device of claim 3, wherein the sensor is an accelerometer, and the first member is curved in shape.

5. The device of claim 1, wherein at least one light of the plurality of lights is configured to illuminate a first color when the bow is oriented at approximately the true vertical position.

6. The device of claim 5, wherein the first color is green, and at least one light is configured to illuminate green when the bow is oriented within 2 degrees from the true vertical position.

7. The device of claim 1, wherein the first light is configured to illuminate when the bow is oriented greater than 2 degrees and up to 20 degrees from the left of the true vertical position.

8. The device of claim 7, wherein the second light is configured to illuminate when the bow is oriented greater than 2 degrees and up to 20 degrees from the right of the true vertical position.

9. The device of claim 1, wherein each of the plurality of lights comprises a light emitting diode (LED).

10. The device of claim 9, wherein the first and second lights are each configured to emit amber light when illuminated.

11. The device of claim 9, further comprising a photoelectric intensity adjustor configured to regulate intensity of the LED.

12. The device of claim 1, wherein:

the first member further comprises a first wing and a second wing;

the first light is located at the first wing;

the second light is located at the second wing; and the first and second wings are each configured to extend adjacent to a length of the sight defining about 30 degrees of a circumference of the sight when the device is attached to the sight.

13. The device of claim 12, wherein the first light extends substantially an entire length of the first wing, and the second light extends substantially an entire length of the second wing.

14. The device of claim 12, wherein the first and second lights each comprise one or more LEDs mounted with one or more light channels.

15. A device for promoting bow accuracy, the device comprising:

a first member configured to be positioned against a first portion of a bow sight, the first member having a plurality of lights located thereat;

a second member configured to be positioned against a second portion of the bow sight behind the first portion;

at least one shaft configured to secure the first and second members opposite one another at the bow sight;

a microcontroller, configured to regulate illumination of the plurality of lights;

a sensor, in electronic communication with the microcontroller;

wherein a first light of the plurality of lights is configured to illuminate when the sensor communicates to the microcontroller that the bow is tilted greater than about 2 degrees to the left from a true vertical position; and wherein a second light of the plurality of lights is configured to illuminate when the sensor communicates to the microcontroller that the bow is tilted greater than about 2 degrees to the right from the true vertical position.

16. A bow comprising a sight, wherein the device of claim 15 is secured to the sight.

17. The device of claim 15, wherein the sensor is an accelerometer.

18. A device for promoting bow accuracy, the device comprising:

a first member comprising a curved surface configured to be positioned against a first portion of a bow sight, the first member having a plurality of LEDs located thereat;

a second member configured to be positioned against a second portion of the bow sight behind the first portion;

at least one shaft configured to secure the first and second members opposite one another at the bow sight;

a microcontroller, configured to regulate illumination of the plurality of LEDs;

an accelerometer, in electronic communication with the microcontroller;

wherein a first LED of the plurality of LEDs is configured to illuminate a first color when the accelerometer communicates to the microcontroller that the bow is tilted greater than about 2 degrees to the left from a true vertical position;

wherein a second LED of the plurality of LEDs is configured to illuminate the first color when the accelerometer communicates to the microcontroller that the bow is tilted greater than about 2 degrees to the right from the true vertical position; and wherein at least one LED of the plurality of LEDs is configured to illuminate a second color when the accelerometer communicates to the microcontroller that the bow is tilted no more than about 2 degrees from the true vertical position.

* * * * *